US008846201B2

(12) United States Patent
Sato et al.

(10) Patent No.: US 8,846,201 B2
(45) Date of Patent: Sep. 30, 2014

(54) COMPOSITE PLATED PRODUCT

(75) Inventors: Tomoyuki Sato, Nagano (JP); Hozumi Yoda, Nagano (JP)

(73) Assignee: Nissei Industrial Plastic Co., Ltd. (JP)

( * ) Notice: Subject to any disclaimer, the term of this patent is extended or adjusted under 35 U.S.C. 154(b) by 602 days.

(21) Appl. No.: 12/380,949

(22) Filed: Mar. 5, 2009

(65) Prior Publication Data

US 2010/0227154 A1 Sep. 9, 2010

(51) Int. Cl.

| | |
|---|---|
| ***B05D 7/14*** | (2006.01) |
| ***G11B 5/708*** | (2006.01) |
| ***G11B 5/735*** | (2006.01) |
| ***B32B 15/08*** | (2006.01) |
| ***C09D 4/00*** | (2006.01) |
| ***C25D 15/00*** | (2006.01) |
| ***C25D 3/16*** | (2006.01) |
| ***C25D 3/18*** | (2006.01) |

(52) U.S. Cl.
CPC *C25D 15/00* (2013.01); *C25D 3/16* (2013.01); *C25D 3/18* (2013.01)
USPC ..... 428/457; 428/323; 428/450

(58) Field of Classification Search
USPC ..... 428/457, 323, 450
See application file for complete search history.

(56) References Cited

U.S. PATENT DOCUMENTS

| | | | | |
|---|---|---|---|---|
| 5,116,430 | A * | 5/1992 | Hirai et al. | 148/518 |
| 2001/0025962 | A1* | 10/2001 | Nakamoto | 257/137 |
| 2008/0008870 | A1* | 1/2008 | Sato et al. | 428/323 |
| 2009/0149594 | A1* | 6/2009 | Noguchi et al. | 524/495 |

FOREIGN PATENT DOCUMENTS

| | | |
|---|---|---|
| JP | 62159864 | 7/1987 |
| JP | 11302856 | 11/1999 |
| JP | 2001000600 | 1/2001 |
| JP | 2005089836 | 4/2005 |
| JP | 2005290463 | 10/2005 |
| JP | 2006028636 | 2/2006 |
| JP | 2008163376 | * 7/2008 |

OTHER PUBLICATIONS

Machine translation of JP2008-163376 (2008).*
Human translation of JP 2008-163376 (2008).*

* cited by examiner

*Primary Examiner* — Samir Shah
(74) *Attorney, Agent, or Firm* — Adams & Wilks

(57) ABSTRACT

A composite plated product has a metal material and a plating film of compounded carbon nanomaterials and microparticles coated on the metal material in a nickel plating bath in which carbon nanomaterials are mixed together with microparticles having an average grain size of 2.5 μm or less.

8 Claims, 4 Drawing Sheets

COMPOSITE PLATED PRODUCT

FIELD OF THE INVENTION

The present invention relates to a composite plated product obtained by covering a metal material with a carbon nanomaterial/hard microparticle/nickel composite plating, and to a method for manufacturing the same.

BACKGROUND OF THE INVENTION

Plating methods for covering the surface of a metal product with a thin film of metal are commonly used to improve the appearance or surface protection of metal products.

Sporting equipment that is plated in this manner to reduce susceptibility to damage is also known, as disclosed in JP 2001-000600 A. In the disclosed sporting equipment, a golf club head having a stainless steel member is plated with a film on at least the stainless steel member, wherein the film has a Vickers hardness of 500 or greater. This plating is formed in two or more layers composed of a bright nickel plating layer and a hard plating layer.

According to testing by the inventors, the bright nickel plating layer or the hard plating layer has a Vickers hardness that is 500 or greater, and is close to 600.

However, it has become apparent that the durable lifetime of the sporting equipment becomes shorter than expected when the Vickers hardness is 500 to 600, as a result of the combined effects of multiple factors such as increased frequency of use of the sporting equipment. This problem can most likely be overcome by increasing the Vickers hardness to 700 or greater, and preferably to 800.

Heat treatment is known as a method for increasing the hardness of a plating layer, as disclosed in JP H11-302856 A. FIGS. 6A and 6B hereof show the heat treatment method disclosed in JP H11-302856 A.

In FIG. 6A, a substrate is hardened in step (hereinafter abbreviated as ST) 101. The hardened substrate is then plated in ST102. The plated substrate is then tempered in ST103.

As shown in FIG. 6B, the unmodified substrate having a hardness of 200 (micro Vickers hardness) is hardened to a hardness of 800 or greater by heat treatment (tempering) at 400° C. Specifically, when the tempering temperature in ST103 is 400° C., precipitation occurs in the plating film, and precipitation hardening progresses. As a result, the hardness of the plating film increases dramatically.

Hardening and tempering of the substrate are accompanied by expansion during heating, and contraction during cooling of the substrate. The substrate sometimes does not completely return to the original shape after this contraction. This dimensional disruption makes it necessary to include a correction step. Since large external forces are applied to the plating film during this correction, the plating film is sometimes destroyed.

A method exists for heating only the plating film and causing precipitation hardening in order to strengthen the plating film. Even in this case, the substrate is expected to flex or distort due to heating. There is therefore a need for a hardening/strengthening method that does not rely on heat treatment or heating.

SUMMARY OF THE INVENTION

An object of the present invention is to provide a composite plating technique capable of strengthening a plating film without the use of a heat treatment or heating.

According to a first aspect of the present invention, there is provided a composite plated product comprising a metal material coated with a plating film in a nickel plating bath in which carbon nanomaterials and hard microparticles are mixed; and the carbon nanomaterials and hard microparticles are compounded in the plating film.

Adding hard microparticles makes it possible to obtain the desired mechanical properties. The carbon nanomaterials can be added in a much smaller amount by adding the hard microparticles. Carbon nanomaterials have a small diameter and a high aspect ratio, and therefore make the plating film prone to lose smoothness. The smoothness of the plating film can thus be maintained when only a small amount of carbon nanomaterials is added.

The hard microparticles are preferably SiC or $SiO_2$, which are inexpensive and readily available.

The hard microparticles preferably have an average particle or grain size of 9.5 nm to 2.5 μm. When the average grain size is greater than 2.5 μm, the hard microparticles are prone to settle on the bottom of the plating tank. When the average grain size is 2.5 μm or less, the hard microparticles do not readily settle, and can be uniformly dispersed in the plating film.

The plating film preferably includes any one of P, B, and W. The mechanical properties can be further enhanced by adding P, B, or W.

According to another aspect of the present invention, there is provided a method for manufacturing a composite plated product comprising the steps of mixing a brightener, a surfactant, carbon nanomaterials, and hard microparticles into a nickel plating solution to prepare a composite plating solution, and placing a metal material in the composite plating solution and performing electroplating, wherein the metal material is coated with a composite plating film in which the carbon nanomaterials and hard microparticles are compounded with nickel or a nickel alloy.

Adding hard microparticles makes it possible to obtain the desired mechanical properties. The carbon nanomaterials can be added in a much smaller amount by adding the hard microparticles. Carbon nanomaterials have a small diameter and a high aspect ratio, and therefore make the plating film prone to lose smoothness. The smoothness of the plating film can thus be maintained when only a small amount of carbon nanomaterials is added. Furthermore, since a high-quality plated product can be manufactured by a common plating operation, the manufacturing cost of the plated product can be prevented from increasing.

The carbon nanomaterials are preferably added in an amount of 0.1 to 1.0 kg per 1 $m^3$ of the plating solution, and the hard microparticles are preferably added in an amount of 0.1 to 1.0 kg per 1 $m^3$ of the plating solution. The mechanical properties can be enhanced in proportion to the added amount of hard microparticles, and the amount of expensive carbon nanomaterials used can also be reduced.

The hard microparticles preferably have an average particle or grain size of 9.5 nm to 2.5 μm. When the average grain size is greater than 2.5 μm, the hard microparticles are prone to settle on the bottom of the plating tank. When the average grain size is 2.5 μm or less, the hard microparticles do not readily settle, and can be uniformly dispersed in the plating film.

The brightener is preferably saccharin sodium and 2-butyne-1,4-diol. Dispersing agents (surfactants) have poor compatibility with brighteners, and some dispersing agents form surface irregularities or lessen the effects of the brightener. Saccharin sodium and 2-butyne-1,4-diol have good compatibility with a surfactant and do not inhibit the action of the surfactant. As a result, the quality of the plating can be increased.

The surfactant is preferably polyacrylic acid. Adding polyacrylic acid makes it possible to suppress aggregation of the carbon nanomaterials.

The polyacrylic acid is preferably mixed in an amount of 0.05 to 0.1 kg per 1 $m^3$ of the plating solution, and the carbon nanomaterials are preferably mixed in an amount of 0.1 to 5.0 kg per 1 $m^3$ of the plating solution. Adding the polyacrylic acid in an amount of 0.1 kg or less makes it possible to prevent decomposition products from precipitating in the plating solution, and for plating to be performed smoothly.

BRIEF DESCRIPTION OF THE DRAWINGS

Certain preferred embodiments of the present invention will be described in detail below, by way of example only, with reference to the accompanying drawings, in which.

DESCRIPTION OF THE PREFERRED EMBODIMENTS

Figure 1:
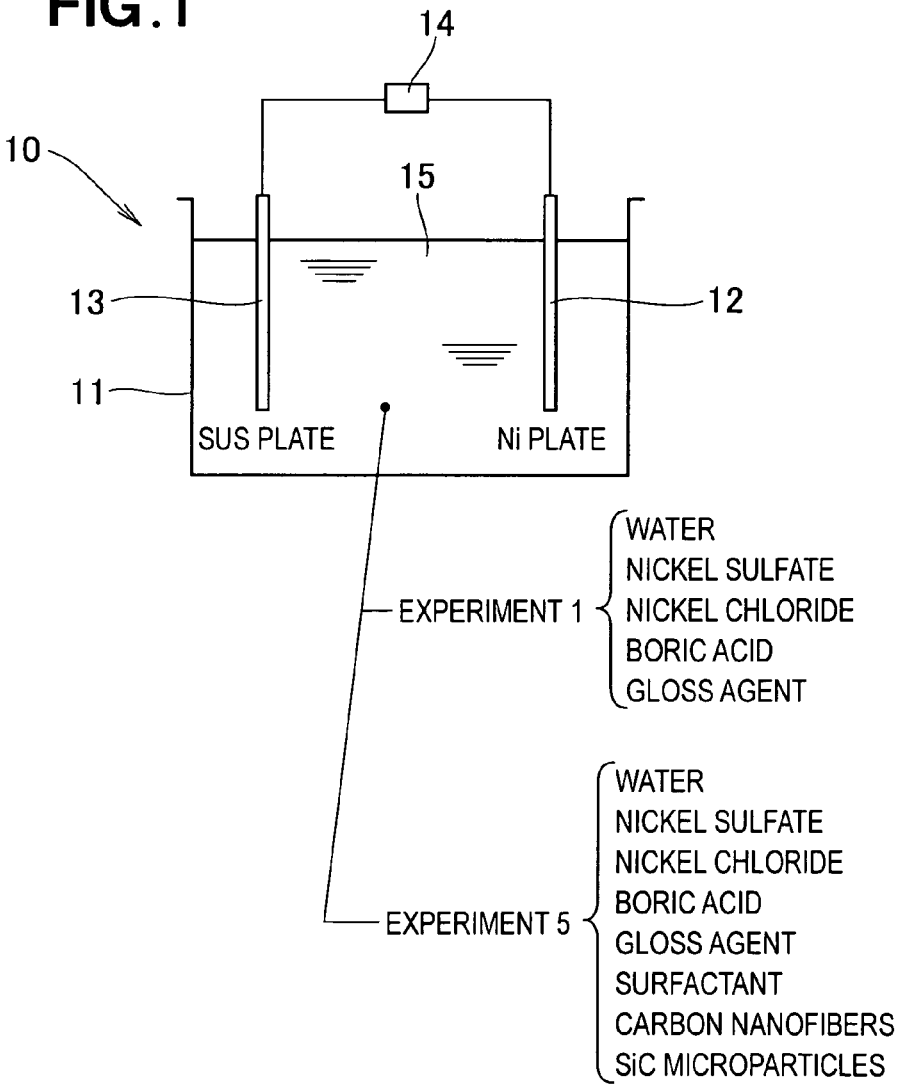
FIG. 1 is a schematic view showing the principle of electroplating equipment according to the present invention.

In the electroplating equipment 10 shown in FIG. 1, a nickel plate 12 is provided as the positive electrode to a plating tank 11, a stainless steel plate or other metal plate 13 is provided as the negative electrode, a power supply 14 is connected to both plates 12, 13, and the plating tank 11 is filled with the plating solution 15 described hereinafter. The stirring means and refluxing means for stirring and refluxing the plating solution 15 are essential, but because publicly known means may be used for stirring and refluxing, no description thereof will be given.

In Experiment 1, the plating solution 15 was composed of water, nickel sulfate, nickel chloride, boric acid, and a brightener; and the plating solution 15 in Experiment 5 was composed of water, nickel sulfate, nickel chloride, boric acid, the brightener, a surfactant, carbon nanofibers, and SiC microparticles. The mixed amounts (added amounts) were as described below.

In Experiment 1, nickel ions reach the metal plate 13, and a nickel coating is formed on the metal plate 13.

In Experiment 5, nickel ions as well as carbon nanofibers and SiC microparticles reach the metal plate 13. Consequently, a coating in which nickel, carbon nanofibers, and SiC microparticles are mixed can be formed on the metal plate 13.

Experiment 1 and Experiment 5 were cited as typical examples. Experiments 2 through 4 and 6 through 8 were conducted, but the details of these experiments as well as Experiment 1 and Experiment 5 will be described in the next (Experiments) section.

EXPERIMENTS

Experiments Relating to the Present Invention Will be Described hereinafter. The present invention is not limited by these experiments.

Conditions in all instances of electroplating:

| | |
|---|---|
| Cathode: | SUS plate (degreased clean plate) |
| Anode: | Electrolytic nickel plate |
| Plating temperature: | 25° C. |
| Current density: | 3 $A/dm^2$ |
| Processing time: | 60 minutes |

Composition of plating solution in Experiment 1:

| | |
|---|---|
| Water: | 1.0 $m^3$ |
| Nickel sulfate: | 240 $kg/m^3$ |
| Nickel chloride: | 45 $kg/m^3$ |
| Boric acid: | 30 $kg/m^3$ |
| Brighteners: | 2-butyne-1,4-diol: 0.2 $kg/m^3$<br>Saccharin sodium: 2 $kg/m^3$ |

Composition of plating solution in Experiment 2:

The following substances were added to the plating solution composition of Experiment 1.

| | |
|---|---|
| Surfactant: | polyacrylic acid: 0.1 $kg/m^3$ |
| Hard microparticles: | SiC having an average grain size of 0.55 μm: 5 $kg/m^3$ |

Composition of plating solution in Experiment 3:

The following substances were added to the plating solution composition of Experiment 1.

| | |
|---|---|
| Surfactant: | polyacrylic acid: 0.1 $kg/m^3$ |
| Carbon nanofibers having an average diameter of 150 nm: | 2 $kg/m^3$ |

Composition of plating solution in Experiment 4:

The following substances were added to the plating solution composition of Experiment 1.

| | |
|---|---|
| Surfactant: | polyacrylic acid: 0.1 $kg/m^3$ |
| Hard microparticles: | $SiO_2$ having an average grain size of 9.5 nm: 2 $kg/m^3$ |

Composition of plating solution in Experiment 5:

The following substances were added to the plating solution composition of Experiment 1.

| | |
|---|---|
| Surfactant: | polyacrylic acid: 0.1 $kg/m^3$ |
| Carbon nanofibers having an average diameter of 150 nm: | 0.1 $kg/m^3$ |
| Hard microparticles: | SiC having an average grain size of 0.55 μm: 0.2 $kg/m^3$ |

Composition of plating solution in Experiment 6:

The following substances were added to the plating solution composition of Experiment 1.

| | |
|---|---|
| Surfactant: | polyacrylic acid: 0.1 $kg/m^3$ |
| Carbon nanofibers having an average diameter of 150 nm: | 0.1 $kg/m^3$ |
| Hard microparticles: | SiC having an average grain size of 2.5 μm: 0.2 $kg/m^3$ |

Composition of plating solution in Experiment 7:

The following substances were added to the plating solution composition of Experiment 1.

| | |
|---|---|
| Surfactant: | polyacrylic acid: 0.1 kg/m$^3$ |
| Carbon nanofibers having an average diameter of 150 nm: | 0.1 kg/m$^3$ |
| Hard microparticles: | $SiO_2$ having an average grain size of 9.5 nm: 2 kg/m$^3$ |

Composition of plating solution in Experiment 8:

The following substances were added to the plating solution composition of Experiment 1.

| | |
|---|---|
| Surfactant | polyacrylic acid: 0.1 kg/m$^3$ |
| Carbon nanofibers having an average diameter of 150 nm: | 0.1 kg/m$^3$ |
| Hard microparticles: | SiC having an average grain size of 0.55 μm: 0.2 kg/m$^3$ |
| Phosphorous acid: | 2 kg/m$^3$ |

The plating solution compositions described above are shown in Table 1 below.

Experiment 7 is an $SiO_2$/CNF/Ni composite plating solution in which carbon nanofibers (CNF) and $SiO_2$ are added to a bright Ni plating solution.

Experiment 8 is an SiC/CNF/PINi composite plating solution in which carbon nanofibers (CNF), SiC, and phosphorous acid are added to a bright Ni plating solution.

Figure 2:
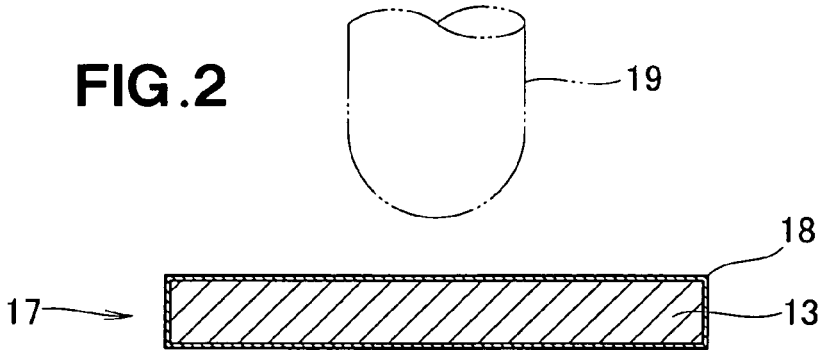
FIG. 2 is a sectional view showing the plated product.

The plated product shown in FIG. 2 was manufactured using each type of plating solution described above.

The plated product 17 shown in FIG. 2 is composed of a metal plate 13, and a plating film 18 coating the metal plate 13. The metal plate 13 is a JIS-specification SUS flat plate having a thickness of 0.2 mm, a longitudinal dimension of 33 mm and a transverse dimension of 30 mm. The thickness of the plating film 18 is approximately 40 μm.

The surface roughness, abrasion resistance of the surface, and surface hardness of such a plated product 17 were measured.

A surface roughness of less than 5 μm as measured by laser microscope was considered good (indicated by the symbol "○"; the same hereinafter), and a surface roughness of 5 μm or greater was considered defective (indicated by the symbol "x"; the same hereinafter).

Abrasion resistance was tested by rubbing a test rod 19 against the plating film 18. An SUS test rod provided with a

TABLE 1

| | Exp. 1 | Exp. 2 | Exp. 3 | Exp. 4 | Exp. 5 | Exp. 6 | Exp. 7 | Exp. 8 |
|---|---|---|---|---|---|---|---|---|
| Water | | 1.0 m$^3$ | | | | | 1.0 m$^3$ | |
| Nickel sulfate | | 240 kg/m$^3$ | | | | | 240 kg/m$^3$ | |
| Nickel chloride | | 45 kg/m$^3$ | | | | | 45 kg/m$^3$ | |
| Boric acid | | 30 kg/m$^3$ | | | | | 30 kg/m$^3$ | |
| Surfactant | | 0.1 kg/m$^3$ | | | | | 0.1 kg/m$^3$ | |
| Brightener: 2-Butyne-1,4-diol | | 0.2 kg/m$^3$ | | | | | 0.2 kg/m$^3$ | |
| Saccharin sodium | | 2 kg/m$^3$ | | | | | 2 kg/m$^3$ | |
| Carbon nanofibers (kg/m$^3$) | | | (avg. diameter 150 nm) 2 | | (avg. diameter 150 nm) 0.1 | (avg. diameter 150 nm) 0.1 | (avg. diameter 150 nm) 0.1 | (avg. diameter 150 nm) 0.1 |
| Hard microparticles: SiC (kg/m$^3$) | | (avg. grain size 0.55 μm) 5 | | | (avg. grain size 0.55 μm) 0.2 | (avg. grain size 2.5 μm) 0.2 | | (avg. grain size 0.55 μm) 0.2 |
| Hard microparticles: $SiO_2$ (kg/m$^3$) | | | | (avg. grain size 9.5 μm) 2 | | | (avg. grain size 9.5 μm) 2 | |
| Phosphorous acid (kg/m$^3$) | | | | | | | | 2 |
| Abbreviations | Bright Ni plating | SiC/Ni composite plating | CNF/Ni composite 0000plating | $SiO_2$/Ni composite plating | SiC/CNF/Ni composite plating | SiC/CNF/Ni composite plating | $SiO_2$/CNF/Ni composite plating | SiC/CNF/P/Ni composite plating |

Specifically, as noted in the bottom line of Table 1, Experiment 1 is a bright Ni plating solution.

Experiment 2 is an SiC/Ni composite plating solution in which SiC is added to a bright Ni plating solution.

Experiment 3 is a CNF/Ni composite plating solution in which carbon nanofibers (CNF) are added to a bright Ni plating solution.

Experiment 4 is an $SiO_2$/Ni composite plating solution in which $SiO_2$ is added to a bright Ni plating solution.

Experiment 5 is an SiC/CNF/Ni composite plating solution in which carbon nanofibers (CNF) and SiC are added to a bright Ni plating solution.

Experiment 6 is an SiC/CNF/Ni composite plating solution. However, the average grain size of the SiC was changed from 0.55 μm to 2.5 μm in contrast to Experiment 5.

spherical surface having a diameter of 10 mm at the distal end thereof was used as the test rod 19. The plating film 18 was contacted at a pressure of 300 g (approximately 3 N), and the test rod was moved back and forth a distance of 10 mm 100 times at a speed of 1000 mm/minute. The depth of abrasion marks formed on the surface of the plating film 18 was measured by laser microscope. A smaller depth of abrasion marks is preferred. Therefore, a depth of less than 10 μm was considered best (indicated by the symbol "◎"; the same hereinafter), a depth of 10 to 15 μm is indicated by ○, and a depth of over 15 μm is indicated by x.

The Vickers hardness was measured by a JIS-specification Vickers hardness tester. Since the present invention aims for a hardness of at least 700, and preferably 800, a hardness of over 800 is indicated by "◎," 700 to 800 by "○," and less than 700 by "x."

Table 2 shows the test results and evaluations.

TABLE 2

| | Exp. 1 | Exp. 2 | Exp. 3 | Exp. 4 | Exp. 5 | Exp. 6 | Exp. 7 | Exp. 8 |
|---|---|---|---|---|---|---|---|---|
| Abbreviations | Bright Ni plating | SiC/Ni composite plating | CNF/Ni composite plating | $SiO_2$/Ni composite plating | SiC/CNF/Ni composite plating | SiC/CNF/Ni composite plating | $SiO_2$/CNF/Ni composite plating | SiC/CNF/P/Ni composite plating |
| Surface roughness Ra (μm) | 0.261 | 1.717 | 8.15 | 0.755 | 1.998 | 4.671 | 1.213 | 2.562 |
| Evaluation | ○ | ○ | X | ○ | ○ | ○ | ○ | ○ |
| Abrasion mark depth | 18.0 μm | 16.8 μm | 10.3 μm | 15.3 μm | 8.3 μm | 9.7 μm | 12.3 μm | 7.7 μm |
| Evaluation | X | X | ○ | X | ◎ | ◎ | ○ | ◎ |
| Vickers hardness | 552 | 705 | 751 | 702 | 763 | 742 | 723 | 825 |
| Evaluation | X | ○ | ○ | ○ | ○ | ○ | ○ | ◎ |
| Overall evaluation | X | X | X | X | ○ | ○ | ○ | ◎ |

In Table 2, the overall evaluation is "x" when a "x" appears in three evaluations.

In Table 2, the overall evaluation is "◎" when there are two or more "◎" in three evaluations.

In Table 2, the overall evaluation is "○" when all entries are "○," or there is one "◎" and two "○" in the three evaluations.

Since the abrasion mark depth exceeded 15.0 μm in Experiments 1, 2, and 4, and the abrasion resisting performance was low, the evaluation of the abrasion mark depth was "x," and a "x" also resulted for the overall evaluation.

Since carbon nanofibers were included in the plating layer in Experiment 3, the lubricating performance of the carbon contributed to the abrasion resisting performance evaluation of "○." However, the carbon nanofibers were added in an excessively large amount, and the surface was therefore dark and not smooth. Specifically, the overall evaluation was "x" for Experiment 3 as well.

The overall evaluation of Experiments 5 through 8 was "○" or "◎." As is apparent from Table 1, the joint use of a small amount (0.1 kg/m$^3$) of carbon nanofibers and a small amount (0.2 to 2 kg/m$^3$) of hard microparticles in Experiments 5 through 8 enabled better results to be obtained than in Experiments 2 through 4.

Specifically, the plated product 17 of the present invention is a plated product in which a metal plate is coated with a plating film in a nickel plating bath in which carbon nanofibers and hard microparticles are mixed, and the carbon nanofibers and hard microparticles are compounded in the plating film.

Mixing in the hard microparticles makes it possible to reduce the necessary amount of carbon nanofibers, and because the carbon nanofibers are added in a smaller amount, the surface roughness can be reduced, and a smooth surface is obtained.

As shown in Table 1, SiC and $SiO_2$ were tested as the hard microparticles, but both types of hard microparticles enabled the carbon nanofibers to be added in a smaller amount.

Since the average grain sizes of the hard microparticles were 9.5 nm (Experiment 7), 0.55 μm (Experiments 5 and 8), and 2.5 μm (Experiment 6), it was confirmed that the average grain size may be selected from a range of 9.5 nm to 2.5 μm.

In Experiment 8, a plating film that included P was obtained by adding phosphorous acid to the plating solution, and as shown in Table 2, this plating, film had high evaluations for surface roughness, abrasion mark depth, and Vickers hardness. Including a small amount of P in the plating film thus enhances performance. Although the test results are not described, the same results as those obtained when P was included were obtained when B and W were tested. Specifically, the plating film preferably includes any one of P, B, and W.

For example, an evaluation ranking next to that of Experiment 8 was obtained in Experiment 5 by adding carbon nanofibers and SiC as hard microparticles in the ratio of 0.1 kg/m$^3$ and 0.2 kg/m$^3$, respectively, to the plating solution. However, the optimum amounts of carbon nanofibers and SiC as hard microparticles are not known. The additional experiments described below were therefore conducted.

Additional Experiments

Conditions in all instances of electroplating in additional experiments:

| | |
|---|---|
| Cathode: | SUS plate (degreased clean plate) |
| Anode: | Electrolytic nickel plate |
| Plating temperature: | 25° C. |
| Current density: | 3 A/dm$^2$ |
| Processing time: | 60 minutes |

Composition of plating solution in additional experiments:

| | |
|---|---|
| Water: | 1.0 m$^3$ |
| Nickel sulfate: | 240 kg/m$^3$ |
| Nickel chloride: | 45 kg/m$^3$ |
| Boric acid: | 30 kg/m$^3$ |
| Surfactant: | polyacrylic acid: 0.1 kg/m$^3$ |
| Brighteners | 2-butyne-1,4-diol: 0.2 kg/m$^3$<br>Saccharin sodium: 2 kg/m$^3$ |

Additional Experiments 1 through 9:

| | |
|---|---|
| Carbon nanofibers: | 0.1 to 5.0 kg/m$^3$ |
| Hard microparticles: | SiC having an average grain size of 0.55 μm: 0.2 kg/m$^3$ (uniform) |

Nine plated products were fabricated under the conditions described above, and the abrasion mark depth of the plating films was measured. The methods for measuring the abrasion mark depth and surface roughness have already been described with reference to FIG. 2, and will not be further described. The results are shown in Table 3 below.

TABLE 3

| Additional Experiments | Additional Experiment No. 1 | 2 | 3 | 4 | 5 | 6 | 7 | 8 | 9 |
|---|---|---|---|---|---|---|---|---|---|
| Water | | | | 1.0 $m^3$ | | | | | |
| Nickel sulfate | | | | 240 $kg/m^3$ | | | | | |
| Nickel chloride | | | | 45 $kg/m^3$ | | | | | |
| Boric acid | | | | 30 $kg/m^3$ | | | | | |
| Surfactant | | | | 0.1 $kg/m^3$ | | | | | |
| Brightener: 2-butyne-1,4-diol | | | | 0.2 $kg/m^3$ | | | | | |
| Saccharin sodium | | | | 2 $kg/m^3$ | | | | | |
| Carbon nanofibers ($kg/m^3$) | 0.1 | 0.2 | 0.3 | 0.4 | 0.6 | 0.8 | 1.0 | 2.0 | 5.0 |
| SiC ($kg/m^3$) | 0.2 | 0.2 | 0.2 | 0.2 | 0.2 | 0.2 | 0.2 | 0.2 | 0.2 |
| Surface roughness Ra (μm) | 1.998 | 2.68 | 2.99 | 3.47 | 3.98 | 4.36 | 4.93 | 6.43 | 10.04 |
| Abrasion mark depth (μm) | 11.0 | 11.2 | 9.5 | 10.4 | 10.7 | 10.8 | 10.9 | 14.2 | 16.3 |

The abrasion mark depths shown in Table 3 were plotted on a graph.

Figure 3:
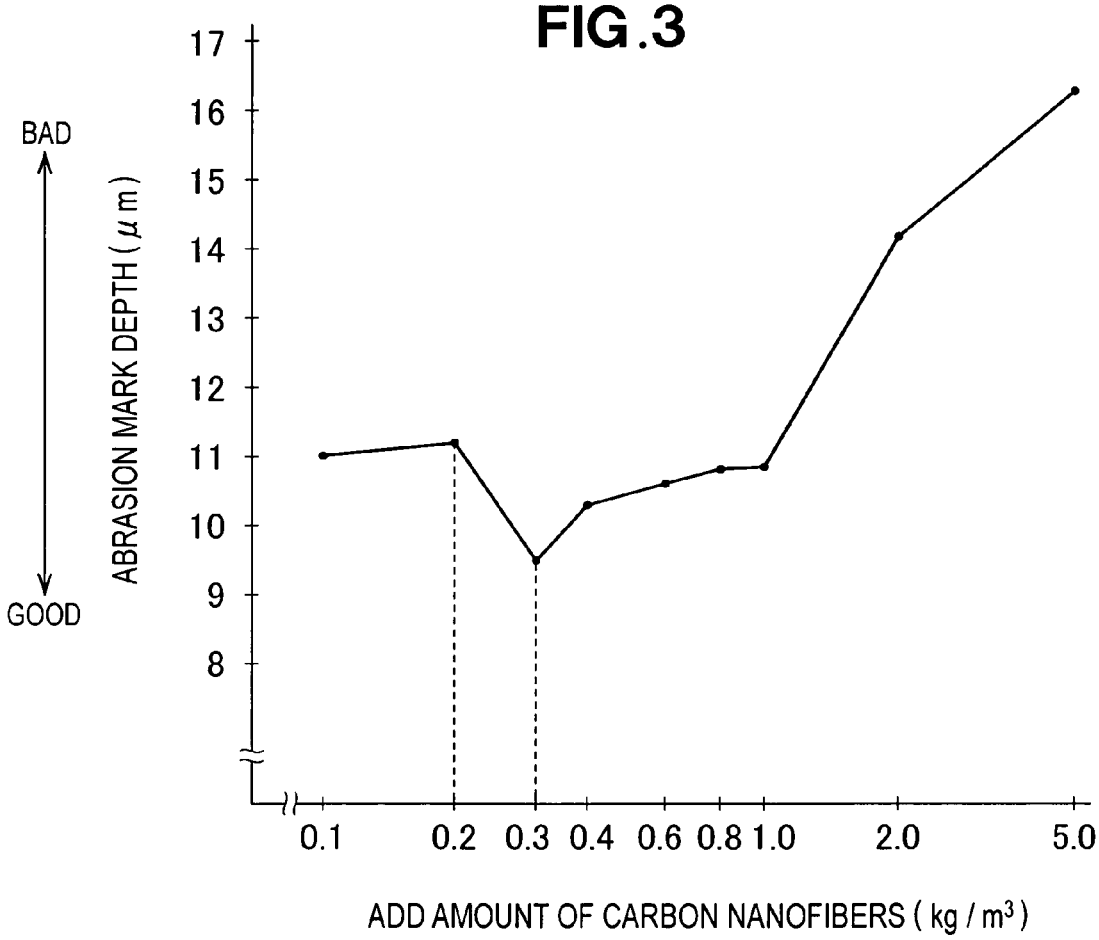
FIG. 3 is a graph showing a relationship between the depth of abrasion marks and the added amount of carbon nanofibers.

FIG. 3 is a graph showing the relationship between the abrasion mark depth and the added amount of carbon nanofibers. The carbon nanofibers were added in an amount of 0.2 to 0.3 $kg/m^3$, and a clear downward-sloping trend was identified. A clear upward trend was identified when more than 1.0 $kg/m^3$ of carbon fibers was added.

The surface roughness increased in proportion to the added amount, and a tendency toward loss of surface smoothness was identified.

When a condition of 11.2 μm or less is set for the abrasion mark depth, the added amount of carbon nanofibers is selected from a range of 0.1 to 1.0 $kg/m^3$.

Since carbon nanofibers are expensive, the added amount of carbon nanofibers may be selected from a range of 0.1 to 0.3 $kg/m^3$ when there is a need to use as small an amount as possible.

Additional Experiments 10 through 20:

| | |
|---|---|
| Carbon nanofibers: | 0.1 $kg/m^3$ (uniform) |
| Hard microparticles: | SiC having an average grain size of 0.55 μm: 0.1 to 10.0 $kg/m^3$ |

Eleven plated products were fabricated under the conditions described above, and the abrasion mark depth of the plating films was measured. The methods for measuring the abrasion mark depth and surface roughness have already been described with reference to FIG. 2, and will not be further described. The results are shown in Table 4 below.

TABLE 4

| Additional Experiments | Additional Experiment No. 10 | 11 | 12 | 13 | 14 | 15 | 16 | 17 | 18 | 19 | 20 |
|---|---|---|---|---|---|---|---|---|---|---|---|
| Water | | | | | | 1.0 $m^3$ | | | | | |
| Nickel sulfate | | | | | | 240 $kg/m^3$ | | | | | |
| Nickel chloride | | | | | | 45 $kg/m^3$ | | | | | |
| Boric acid | | | | | | 30 $kg/m^3$ | | | | | |
| Surfactant | | | | | | 0.1 $kg/m^3$ | | | | | |
| Brightener: 2-butyne-1,4-diol | | | | | | 0.2 $kg/m^3$ | | | | | |
| Saccharin sodium | | | | | | 2 $kg/m^3$ | | | | | |
| Carbon nanofibers ($kg/m^3$) | 0.1 | 0.1 | 0.1 | 0.1 | 0.1 | 0.1 | 0.1 | 0.1 | 0.1 | 0.1 | 0.1 |
| SiC ($kg/m^3$) | 0.1 | 0.2 | 0.4 | 0.6 | 0.8 | 1.0 | 2.0 | 3.0 | 4.0 | 5.0 | 10.0 |
| Surface roughness Ra (μm) | 1.826 | 1.998 | 2.038 | 2.195 | 2.624 | 2.729 | 2.867 | 2.891 | 2.923 | 3.061 | 3.266 |
| Abrasion mark depth (μm) | 11.2 | 11.0 | 10.7 | 9.3 | 8.1 | 7.3 | 8.9 | 10.5 | 10.2 | 9.7 | 10.1 |

The abrasion mark depths shown in Table 4 were plotted on a graph.

Figure 4:
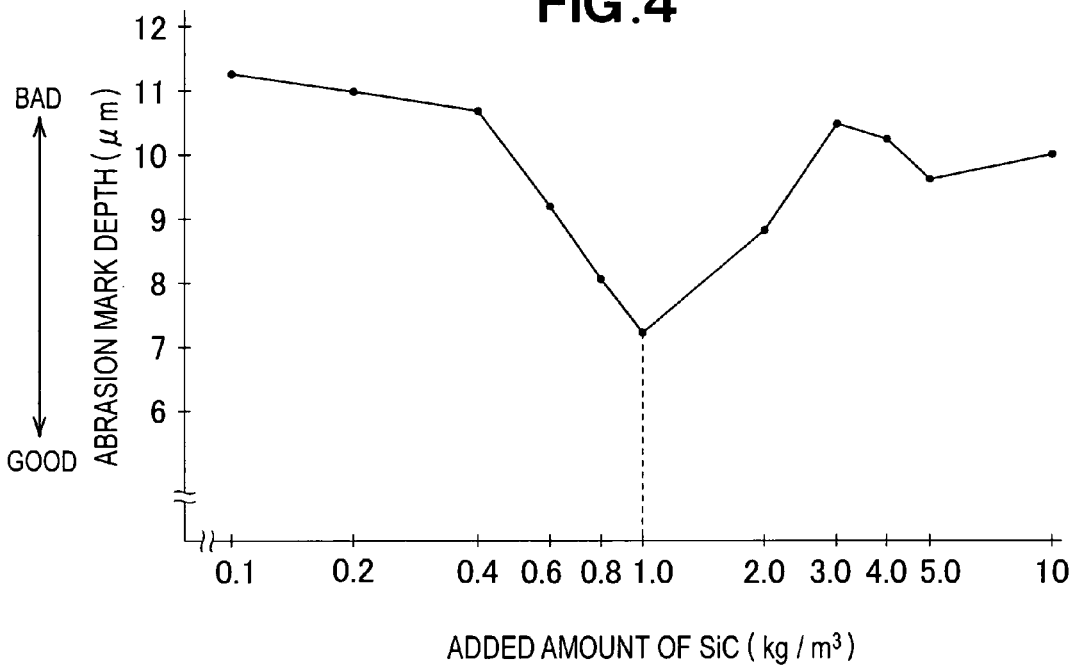
FIG. 4 is a graph showing a relationship between the depth of abrasion marks and the added amount of SiC.

FIG. 4 is a graph showing the relationship between the abrasion mark depth and the added amount of SiC.

SiC was added in an amount of 0.1 to 1.0 $kg/m^3$, and a clear downward-sloping trend was identified. A clear upward trend was identified when more than 1.0 $kg/m^3$ of SiC was added.

The surface roughness was shown to increase in proportion to the added amount of SiC, but it was confirmed that the effect on smoothness was smaller than that of adding carbon nanofibers. The reason for this is considered to be that the SiC as the hard microparticles has a small grain size, and does not have such a high aspect ratio as the carbon nanofibers.

Since the SiC is in the form of hard microparticles, the SiC separates into free particles during abrasion and subsequently damages the plating film. There is therefore a need to minimize the amount of SiC mixed into the plating solution (in this regard, the only problem with carbon nanofibers is high cost, and there is no risk of damage by carbon nanofibers).

Since the SiC is added in order to increase abrasion resistance, the range of added amounts in the upward-sloping area of FIG. 4 cannot be used. Therefore, the added amount of SiC is preferably selected from the range of 0.1 to 1.0 $kg/m^3$.

According to the additional experiments (Additional Experiments 1 through 20) described above, the carbon nanofibers are preferably added in an amount of 0.1 to 1.0 $kg/m^3$ per 1 $m^3$ of the plating solution, and the hard microparticles are preferably added in an amount of 0.1 to 1.0 $kg/m^3$ per 1 $m^3$ of the plating solution.

In Experiments 5 through 8 and the additional experiments (Additional Experiments 1 through 20) described above, 0.1 $kg/m^3$ of polyacrylic acid was added as the surfactant. The polyacrylic acid has the important function of preventing aggregation of the carbon nanofibers. The amount of the polyacrylic acid added is also important. The relationship between the added amount of carbon nanofibers and the added amount of polyacrylic acid was therefore investigated. The results are shown in FIG. 5.

Figure 5:
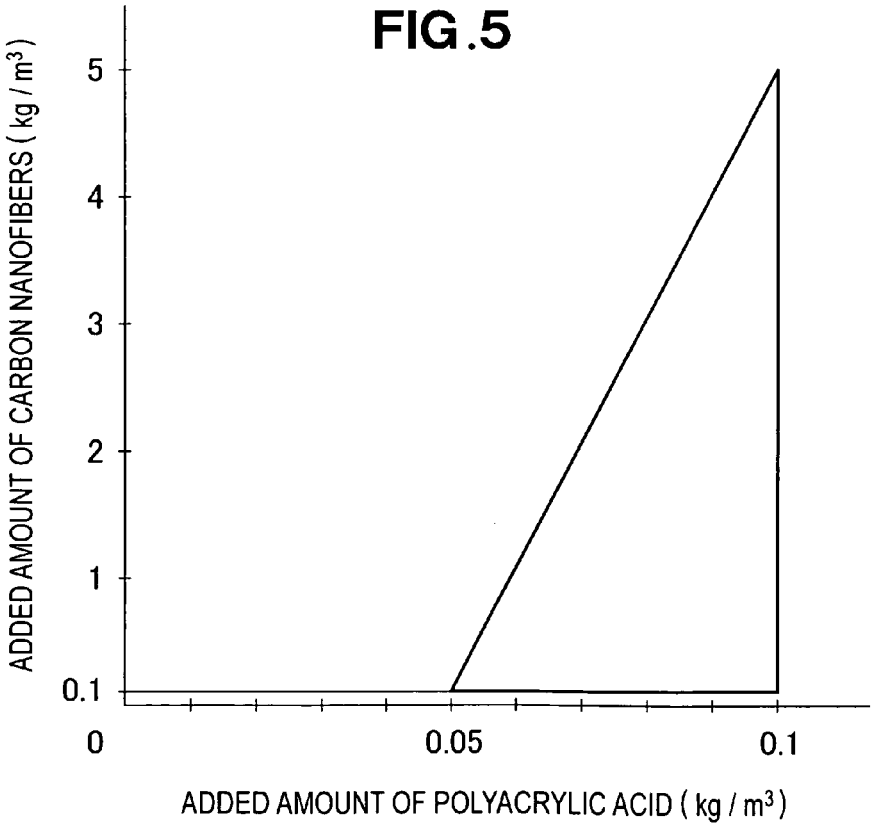
FIG. 5 is a graph showing a relationship between the added amount of polyacrylic acid and the added amount of carbon nanofibers.
Figure 6A:
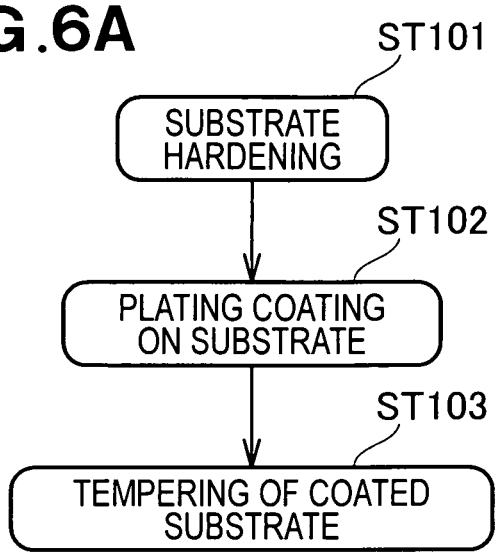
FIGS. 6A and 6B illustrate the basic principle of a conventional heat treatment method.
Figure 6B:
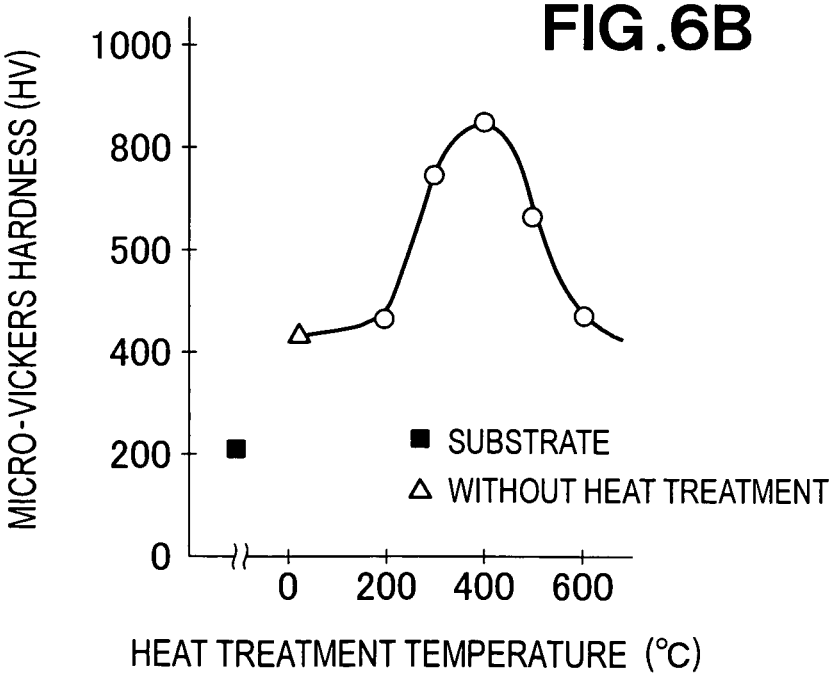

FIG. 5 is a view showing the relationship between the added amount of polyacrylic acid and the added amount of carbon nanofibers in the present invention, wherein the horizontal axis shows the added amount of polyacrylic acid, and the vertical axis shows the added amount of carbon nanofibers.

As described with reference to Table 2, the state of compounding was satisfactory when the amount of polyacrylic acid was 0.1 $kg/m^3$ and the amount of carbon nanofibers was in the range of 0.1 to 5 $kg/m^3$. Therefore, when different amounts of polyacrylic acid were evaluated, the dispersion capability was low when the added amount was less than 0.05 $kg/m^3$, and the carbon nanofibers aggregated. Added amounts of more than 0.1 $kg/m^3$ were excessive and caused decomposition products to precipitate in the plating solution, and the precipitates reduced the quality of the plating.

The amount of polyacrylic acid should be increased in proportion to the added amount of carbon nanofibers, and the range of appropriate quantities of polyacrylic acid is therefore in the large triangular region formed by the coordinates (0.05, 0.1), (0.1, 0.1), and (0.1, 5.0).

Specifically, the polyacrylic acid is preferably mixed in the ratio of 0.05 to 0.1 kg per 1 $m^3$ of the plating solution, and the carbon nanofibers are preferably mixed in the ratio of 0.1 to 5.0 kg per 1 $m^3$ of the plating solution.

It is sufficient insofar as the nickel plating bath is primarily composed of at least one type of nickel compound selected from nickel sulfate, nickel chloride, and nickel sulfamate, and the experiments and additional experiments described above are not limiting.

Experiments were conducted for a stainless steel plate as well as an aluminum plate, a copper plate, and an iron plate as the metal plate 13. There were no problems in the adhesion of the plating film in any of these cases, and the operation and effects of the present invention were confirmed.

It is sufficient insofar as the metal plate 13 is a metal material on which a plating is applied, and the shape thereof is not limited.

The present invention is suitable as a plated coating applied to sporting equipment, machine components, and sliding components.

It will readily be appreciated by one skilled in the art that the above-described carbon nanofibers may be any nano-size carbon materials including carbon nanotubes.

Obviously, various minor changes and modifications of the present invention are possible in light of the above teaching. It is therefore to be understood that within the scope of the appended claims the invention may be practiced otherwise than as specifically described.

What is claimed is:

1. A composite plated product comprising: a metal material; and a plating film of compounded carbon nanofibers and microparticles coated on the metal material in a nickel plating bath in which carbon nanofibers in an amount of 0.1 kg per 1 $m^3$ of the nickel plating bath are mixed together with microparticles of SiC in an amount of 0.2 kg per 1 $m^3$ of the nickel plating bath, the plating film including any one of phosphorus (P), boron (B) and tungsten (W).

2. The composite plated product according to claim 1, wherein the carbon nanofibers have an average diameter of 150 nm.

3. The composite plated product according to claim 1, wherein the plating film includes phosphorus added in an amount of 2 kg per 1 $m^3$ of the nickel plating bath.

4. The composite plated product according to claim 1, wherein the plating film has a surface roughness of less than 5 μm and a Vickers hardness of at least 800.

5. The composite plated product according to claim 1, wherein the plating film has a thickness of approximately 40 μm.

6. The composite plated product according to claim 2, wherein the plating film includes phosphorus added in an amount of 2 kg per 1 $m^3$ of the nickel plating bath.

7. The composite plated product according to claim 2, wherein the plating film has a surface roughness of less than 5 μm and a Vickers hardness of at least 800.

8. The composite plated product according to claim 2, wherein the plating film has a thickness of approximately 40 μm.

* * * * *